US007397354B1

(12) United States Patent
Easton

(10) Patent No.: US 7,397,354 B1
(45) Date of Patent: Jul. 8, 2008

(54) COOLING SYSTEM MONITORING SYSTEM

(75) Inventor: David Joseph Easton, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/651,787

(22) Filed: Jan. 9, 2007

(51) Int. Cl.
*B60Q 1/00* (2006.01)

(52) U.S. Cl. ..... 340/449; 123/198 D; 123/351; 123/41.12; 123/41.15; 340/438

(58) Field of Classification Search ..... 340/425.5, 340/584, 438, 441, 449; 123/41.15, 41.12, 123/41.31, 339.15, 339.22, 198 D, 351; 417/423.1
See application file for complete search history.

(56) References Cited

U.S. PATENT DOCUMENTS 4,526,481 A * 7/1985 Hansen ..... 374/144
5,612,672 A * 3/1997 Ino et al. ..... 340/449
6,321,695 B1 * 11/2001 Yoo et al. ..... 123/41.15
6,481,388 B1 * 11/2002 Yamamoto ..... 123/41.12
2002/0066422 A1 * 6/2002 Hawkins et al. ..... 123/41.12
2006/0062678 A1 * 3/2006 Furuta et al. ..... 417/423.1
2006/0254540 A1 * 11/2006 Tuttle ..... 123/41.49

* cited by examiner

*Primary Examiner*—Brent A. Swarthout

(57) ABSTRACT

The invention relates to an engine cooling system monitoring system. There is a need for a cooling system monitoring system for an engine system wherein the coolant is maintained at a precise temperature. Thus, a cooling system monitoring system is provided for an engine system having internal combustion engine, a fan driven by a variable speed fan drive, and a radiator for cooling coolant circulating through the engine. The monitoring system includes a fan speed sensor generating a fan speed signal, a control unit and a display device controlled by the control unit. The control unit generates a cooling system status signal as a function of the fan speed signal and a maximum fan speed value. The display device has visible position range associated with a normal engine operating temperature, and has an indicator movable within said position range in response to the cooling system status signal to indicate a status of the engine cooling system.

15 Claims, 1 Drawing Sheet

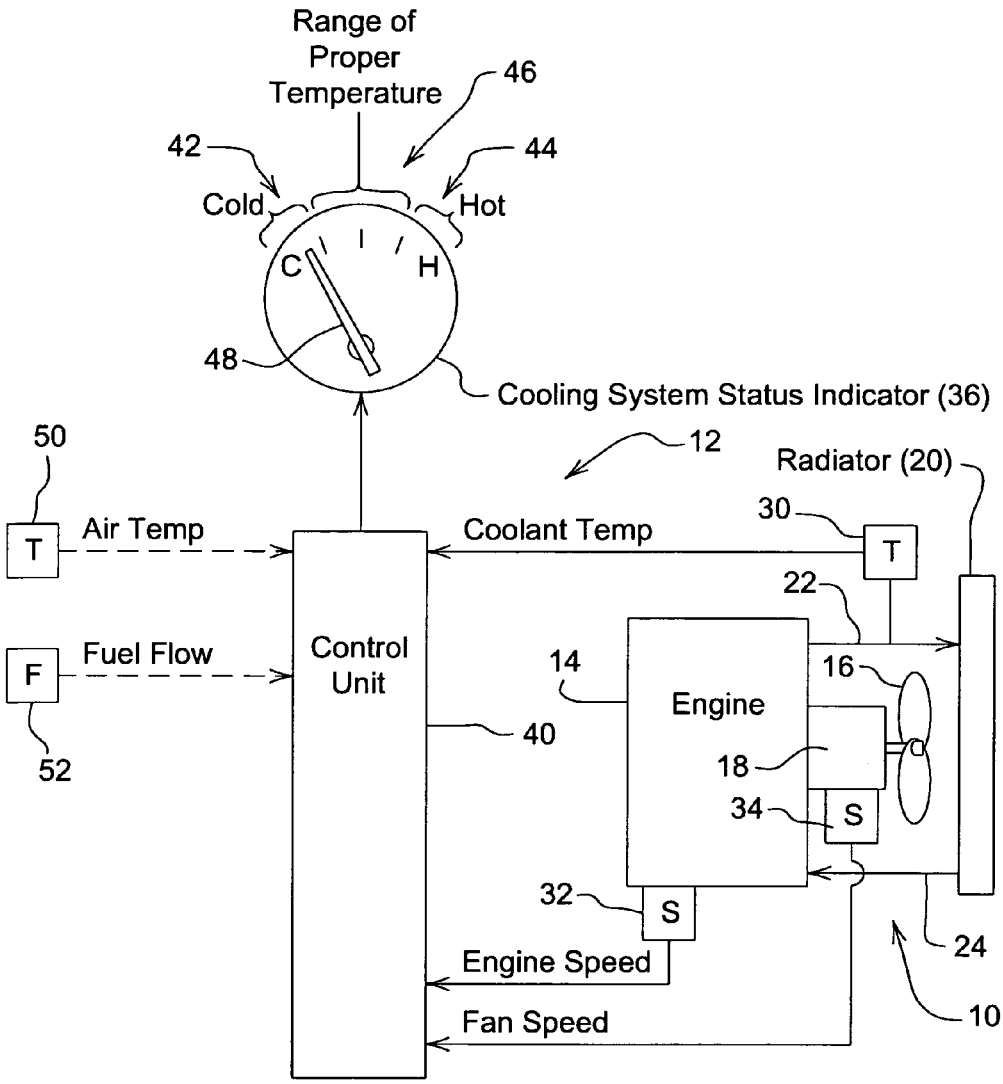
Range of
Proper
Temperature
46
42
44
Cold
Hot
C
H
48
Cooling System Status Indicator (36)
12
50
Radiator (20)
30
T
Air Temp
Coolant Temp
T
22
F
Fuel Flow
Control
Unit
14
Engine
16
40
18
52
34
S
32
S
24
Engine Speed
10
Fan Speed

COOLING SYSTEM MONITORING SYSTEM

FIELD OF THE INVENTION

The present invention relates to a system for monitoring the cooling system of an internal combustion engine.

BACKGROUND OF THE INVENTION

It is well known to use a coolant temperature indicator or temperature gauge with an internal combustion engine so that the operator can conveniently assess the engine operating temperature and estimate the likelihood that the engine may leave the range of acceptable conditions. However, with newer methods of controlling the coolant temperature, such as electronic thermostats and actively controlled fan speed, the coolant is maintained at such a precise temperature that the temperature gauge no longer provides information about the adequacy of the cooling system under current engine operating conditions. The operator cannot determine from the coolant temperature whether the cooling system is running at 10% or 98% of capability. Although displaying other parameters such as fan speed or thermostat position might allow an engine operator to make a more knowledgeable assessment, it would also increase the skill requirement of the operator. This is especially true for engines that are routinely operated over a range of speeds.

SUMMARY OF THE INVENTION

Accordingly, an object of this invention is to provide a system for monitoring the cooling system of an internal combustion engine.

A further object of the invention is to provide such a monitoring system which does not require a significant increase in operator skill.

These and other objects are achieved by the present invention, wherein a cooling system monitoring system is provided for an engine system having an internal combustion engine, a fan driven by a variable speed electric motor or by variable speed mechanical drive driven by the engine, and a radiator for cooling coolant circulating through the engine. The monitoring system includes a coolant temperature sensor, a fan speed sensor, (an engine speed sensor—in the case of variable speed mechanical drive), a control unit and a display device. The control unit generates a cooling system status signal as a function of the sensed signals. The display device includes visible indications representing the engine cooling system, and an indicator controlled in response to the status signal to selectively indicate the condition of the cooling system. The control unit generates the status signal as a function of a difference between the fan speed signal and a stored or calculated maximum fan speed.

BRIEF DESCRIPTION OF THE DRAWING

The sole FIGURE is a simplified schematic diagram of a cooling system monitoring system embodying the invention.

DESCRIPTION OF THE PREFERRED EMBODIMENT

Referring to the sole FIGURE, an engine system 10 includes an internal combustion engine 14, a fan 16 driven by a variable speed fan drive 18, and a radiator 20 connected by coolant lines 22 and 24 to the engine 14 so that the radiator 20 cools coolant which circulates through the engine 14. The fan drive 18 may be a mechanical drive mechanically driven by the engine 14, or it may be an electric motor powered by the vehicle electrical power system (not shown).

According to the present invention, a monitoring system 12 is provided for engine system 10. For the case of an electric motor fan drive 18, the monitoring system 12 includes a coolant temperature sensor 30, a fan speed sensor 34, a temperature display 36 and an electronic control unit 40. Coolant temperature sensor 30 senses coolant temperature and generates a coolant temperature signal. Fan speed sensor 34 senses the speed of fan 16 and generates a fan speed signal.

For the case of a mechanical variable speed fan drive 18, the monitoring system 12 includes a coolant temperature sensor 30, an engine speed sensor 32, a fan speed sensor 34, a temperature display 36 and an electronic control unit 40. Coolant temperature sensor 30 senses coolant temperature and generates a coolant temperature signal. Engine speed sensor 32 senses the speed of the engine 14 and generates an engine speed signal. Fan speed sensor 34 senses the speed of fan 16 and generates a fan speed signal.

Temperature display 36 includes visual areas or symbols having indications representing engine operating temperature, including a cold indication 42, a hot indication 44 and a proper temperature range indication 46. Display 36 also includes a pointer or indicator or needle 48 which is controlled in response to an input or cooling system status signal from the electronic control unit 40 to selectively indicate the one of display indications 42, 44 or 46. The present invention could also be applied to a display (not shown) which includes only the normal coolant temperature operating range 46 and which eliminates the cold and hot regions 42 and 44. In this case, the cold and hot indications could be shown in a separate display (not shown).

For the case of an electric motor fan drive 18, the control unit 40 generates the input signal as a function of the coolant temperature signal and the fan speed signal. The control unit 40 compares the sensed fan speed to a stored maximum fan speed, and moves the needle 48 toward hot range 44 as the sensed fan speed approaches the maximum. For an electric motor driven fan, the maximum speed will be some constant number.

For the case of a mechanical variable speed fan drive 18, the control unit 40 generates the input signal as a function of the coolant temperature signal, the engine speed signal and the fan speed signal. In this case, the control unit 40 calculates a maximum fan speed value as some ratio times the engine speed. The control unit then compares the sensed fan speed to this maximum fan speed value and moves the needle toward hot region 44 as it approaches the maximum.

As a result, when the coolant temperature is within the proper operating range 46, the indication is no longer merely one of temperature, but one of cooling system adequacy. The portion of region 46 just above the cold indication 42 indicates that the temperature is correct, and there is plenty of additional cooling capacity available through increased fan speed. The portion of region 46 just below the hot indication 44 indicates that the temperature is correct, but that the cooling system is very nearly at its maximum cooling capability (maximum fan speed) for the present conditions.

Thus, within range 46, the position of indicator 48 is preferably proportional to a difference between a stored or calculated maximum or threshold value and the sensed fan speed. As the sensed fan speed approaches the maximum value, this is an indication that the cooling system is approaching the limit of its capability or cooling capacity.

Preferably, the display includes indicia corresponding to when the engine coolant temperature is above or below a proper operating temperature. This can be as is done conventionally with a gauge or display with a blue region for cold coolant and a red region for excessively hot coolant, for example. However, with the present invention, information about the degree of utilization of the cooling system is conveyed by the position of an indicator in a region of the gauge during which the coolant is at a desired operating temperature. The new system displays information relating to cooling system adequacy. No special skill or knowledge is required of the operator.

In an alternative embodiment, the system could also include an ambient air temperature sensor 50. In this embodiment, the control unit 40 would be programmed to vary the maximum anticipated speed value for different sensed ambient temperatures.

In a further alternative embodiment, the system may also include an ambient air temperature sensor 50 and a fuel flow sensor 52. In this embodiment, the control unit 40 can be programmed with the anticipated fan speed required to cool the engine under the present fuel consumption and air temperature conditions. If the required cooling capacity is not attained with the anticipated fan speed, the operator may be notified of an incipient problem, such as plugged heat exchanger or air inlet screens. For example, if the engine is running at its rated speed with high fuel consumption, the anticipated fan speed will be slow if the air into the cooling system is cold, but much faster on a hot day. But if the fan must run at a high speed on a cool day in order to maintain proper coolant temperature, this would be an indication that air flow is being constricted or some other problem is beginning. The operator can be notified of a concern even though operating temperature limits are not yet approached.

The display 36 could be a mechanical, electronic or digital display, embodied in hardware or emulated in a computer controlled graphics screen. It could be a needle/dial type display as shown in the FIGURE, or any other suitable type of display, such as a text or bar graph display.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An engine cooling system monitoring system for an engine system having an internal combustion engine, a fan driven by a variable speed fan drive, and a radiator for cooling coolant circulating through the engine, the monitoring system comprising:

a fan speed sensor generating a fan speed signal;

a control unit for generating a cooling system status signal as a function of the fan speed signal and a maximum fan speed value; and a display device having visible position range associated with a normal engine operating temperature, and the display having an indicator movable within said position range in response to the cooling system status signal to indicate a status of the engine cooling system.

2. The engine cooling system monitoring system of claim 1, wherein:

the variable speed fan drive comprises an electric motor.

3. The engine cooling system monitoring system of claim 2, wherein:

the control unit compares the sensed fan speed to a stored constant maximum fan speed, and causes an adjustment of the display device as the sensed fan speed approaches the maximum.

4. The engine cooling system monitoring system of claim 1, wherein:

the control unit compares the sensed fan speed to a stored maximum fan speed, and adjusts the display device as a function of a difference between the sensed fan speed the maximum fan speed.

5. The engine cooling system monitoring system of claim 1, wherein:

the variable speed fan drive is mechanically driven by the engine; and the monitoring system includes an engine speed sensor generating an engine speed signal, the control unit generating the cooling system status signal as a function of the coolant temperature signal, the engine speed signal and the fan speed signal.

6. The engine cooling system monitoring system of claim 5, wherein:

the control unit 40 calculates a maximum fan speed value as a ratio times the engine speed, and the control unit generating the cooling system status signal as a function of a comparison of the sensed fan speed and said calculated maximum fan speed value.

7. The engine cooling system monitoring system of claim 1, further comprising:

a coolant temperature sensor generating a coolant temperature signal, and the control unit generating the cooling system status signal as a function of the coolant temperature signal and the fan speed signal.

8. The engine cooling system monitoring system of claim 7, wherein:

the display includes a cold visible position range associated with an engine operating temperature colder than said normal operating temperature, and a hot visible position range associated with an engine operating temperature hotter than said normal operating temperature.

9. The engine cooling system monitoring system of claim 1, further comprising:

an ambient air temperature sensor generating an ambient air temperature signal, the control unit varying the maximum fan speed value as a function of the ambient air temperature signal.

10. A engine cooling system monitoring system for an engine system having internal combustion engine, a fan driven by an engine driven mechanical variable speed fan drive, and a radiator for cooling coolant circulating through the engine, the monitoring system comprising:

an engine speed sensor generating an engine speed signal;

a fan speed sensor generating a fan speed signal;

a control unit for generating a cooling system status signal as a function of the fan speed signal and the engine speed signal; and a display device having visible position range associated with a proper engine operating temperature, and the display having an indicator movable within said position range in response to the cooling system status signal to indicate a status of the engine cooling system.

11. The engine cooling system monitoring system of claim 10, wherein:

the control unit calculates a maximum fan speed value as a function of the sensed engine speed, and the control unit generating the cooling system status signal as a function of a comparison of the sensed fan speed and said calculated maximum fan speed value.

12. The engine cooling system monitoring system of claim 11, further comprising:

an ambient air temperature sensor generating an ambient air temperature signal, the control unit varying the maximum fan speed value as a function of the ambient air temperature signal.

13. A engine cooling system monitoring system for an engine system having internal combustion engine, a fan, a variable speed electric motor fan drive driving the fan, and a radiator for cooling coolant circulating through the engine, the monitoring system comprising:

a fan speed sensor generating a fan speed signal;

a control unit for generating a cooling system status signal as a function of the fan speed signal and a stored maximum fan speed value; and a display device having visible position range associated with a proper engine operating temperature, and the display having an indicator movable within said position range in response to the cooling system status signal to indicate a status of the engine cooling system.

14. The engine cooling system monitoring system of claim 13, wherein:

the control unit adjusts the display device as a function of a difference between the sensed fan speed and the maximum fan speed value.

15. The engine cooling system monitoring system of claim 13, further comprising:

an ambient air temperature sensor generating an ambient air temperature signal, the control unit varying the maximum fan speed value as a function of the ambient air temperature signal.

* * * * *